US006142322A

United States Patent [19]

Smith et al.

[11] Patent Number: 6,142,322

[45] Date of Patent: Nov. 7, 2000

[54] PLASTIC SHELF RAILS FOR ELECTRONIC SHELF LABELS AND LOCKING CLIPS FOR ATTACHING SAME TO METAL SHELVES

[75] Inventors: Maria-Teresa Smith, New Canaan; Walter J. Janczyk, Burlington; James E. Richardson, Weston, all of Conn.

[73] Assignee: ERS International, Inc., Norwalk, Conn.

[21] Appl. No.: 09/227,282

[22] Filed: Jan. 6, 1999

Related U.S. Application Data

[60] Provisional application No. 60/086,651, May 26, 1998, provisional application No. 60/086,678, May 26, 1998, and provisional application No. 60/091,402, Jun. 29, 1998.

[51] Int. Cl.[7] ..... A47F 5/00

[52] U.S. Cl. ..... 211/183; 40/661.03; 40/642.02; 29/428; 428/98

[58] Field of Search ..... 211/153, 135, 211/183; 40/661.03, 651, 661, 647, 648, 642.02, 655, 657; 248/231.21; 29/428; 108/27; 428/98

[56] References Cited

U.S. PATENT DOCUMENTS

| | | | |
|---|---|---|---|
| 5,111,196 | 5/1992 | Hunt . | |
| 5,241,467 | 8/1993 | Failing et al. . | |
| 5,245,534 | 9/1993 | Waterhouse et al. . | |
| 5,553,412 | 9/1996 | Briechle et al. . | |
| 5,575,100 | 11/1996 | Marvin et al. | 40/642 |
| 5,715,622 | 2/1998 | Giordano | 40/661.03 |
| 5,816,550 | 10/1998 | Watanabe et al. | 40/657 X |
| 5,899,011 | 5/1999 | Brinkman | 40/661.03 |
| 6,000,611 | 12/1999 | Palton et al. | 40/661.03 X |

FOREIGN PATENT DOCUMENTS

WO96 27957 9/1996 WIPO .

*Primary Examiner*—Robert W. Gibson, Jr.
*Attorney, Agent, or Firm*—Oppedahl & Larson LLP

[57] ABSTRACT

A device is provided for mounting shelf labels on supermarket shelving with a C-channel. Metal shelving is shaped to define a slot extending below the shelf between the flat shelf and the front curved surface, the lower edge of which is shaped to form a return. A metal clip fits into the slot to form a second return opposite the first return. A rail with a bracket and slide engage the first and second returns for mounting shelf labels. Plastic shelf rails for mounting wireless electronic shelf labels are also provided. The lower groove of the rail is shaped to engage latches at the bottom of the electronic shelf label which can only be removed by using a special tool. Also provided is a shelf rail made by co-extruding flexible and rigid polyvinyl chloride (PVC) materials. The plastic shelf rails have a notch on the back to accommodate metal shelf brackets. To prevent the electronic shelf labels from sliding, they are held firmly in place by a gripping pad. Shelf rails optimized for lower shelves tilt the electronic price display upwards. Two transparent plastic covers for the shelf rail and a plastic shelf rail with integrated cover are co-extruded with resilient ridges for holding paper or plastic cards. A holder, which attaches to a supermarket shelf C-channel, holds the electronic shelf label. A holder for use without shelves has an adhesive backing.

21 Claims, 7 Drawing Sheets

PLASTIC SHELF RAILS FOR ELECTRONIC SHELF LABELS AND LOCKING CLIPS FOR ATTACHING SAME TO METAL SHELVES

This application claims priority from U.S. Provisional Application Nos. 60/086,651 filed May 26, 1998, 60/086,678 filed May 26, 1998 and 60/091,402 filed Jun. 29, 1998, which are incorporated herein by reference.

BACKGROUND OF THE INVENTION

This invention relates to shelving and rails for mounting electronic price displays in retail stores. Pricing the thousands of items on supermarket shelves has traditionally been an arduous and time-consuming task. In the past, legions of stock clerks were kept continuously busy pricing everything from bottled juice to soup cans. Over the years, there were some improvements in pricing methods such as bar coding, but a truly cost-effective and time-saving pricing method became available only with the advent of the electronic shelf label.

As the name implies, an electronic shelf label replaces paper price tags on supermarket shelves with a plastic housing containing an electronically activated liquid crystal display. This display provides shoppers and supermarket employees with accurate and timely pricing, product, and merchandising information.

With electronic shelf labels, shoppers can rely on the price they see at the shelf edge to be the same as the price that is scanned at the checkout counter. In addition to ensuring price integrity for supermarket customers, the system serves as a valuable management tool. Each electronic shelf label contains memory registers that can store and display on demand product information other than prices. Two-way communications capability allows the electronic shelf labels to receive price, product, merchandising, or ordering data and to transmit responses as well.

In one system, electronic shelf labels are wired in a store-wide network. Electronic shelf labels on store shelves and gondolas are wired to a controller that communicates with a computer in the back of the store. This wired-in system is described in U.S. Pat. No. 5,553,412, which is incorporated herein by reference. The means and methods to collect, maintain, and use location information on each electronic shelf label and the product it represents is described in U.S. Pat. No. 5,241,467, Failing et al., and U.S. Pat. No. 5,245,534, Waterhouse et al., which are incorporated herein by reference. This information is then used to cause all electronic shelf labels in an area or sub-area to change their displays in response to a user request initiated by a hand held unit, a special purpose module, an initiator, or a display function switch.

A wireless system has been developed and is described in WO 96/27957, which is incorporated herein by reference. The wireless electronic shelf labels are radio transponders and display price and product information received via RF signals from antennas mounted to, below or above the store ceilings. One previously used structure employs aluminum shelf rails along with labels connected by wiring. But such a structure does not work well with a wireless system in which radio waves are used for communication between the individual electronic shelf labels. The metal interferes with the transmission of radio waves used in the wireless system, causing problems in communicating price changes and product information to the electronic shelf labels.

Conventional steel shelving has a front curved surface to hold strips of paper describing and pricing the item on the shelves. Some steel shelving has top and bottom returns on the front curved section, referred to as a C-channel. There are many ways to mount other items (including price display rails) to the steel shelves when it includes the C-channel because items can be braced against the returns. Some existing steel shelves do not have a return on the top edge, making it difficult to mount items securely to the shelf.

A means for mounting items to shelves without a C-channel and a non-metal shelf rail for use with the wireless electronic shelf labels and adaptable for use with conventional supermarket shelving would have significant commercial impact.

SUMMARY OF THE INVENTION

A means is provided for mounting shelf labels on supermarket shelving without a C-channel. Metal shelving is shaped to define a slot extending below the shelf between the flat shelf and the front curved surface, the lower edge of which is shaped to form a return. A metal clip fits into the slot to form a second return opposite the first return. A rail with a bracket and slide engage the first and second returns for mounting shelf labels.

Another embodiment is the provision of plastic shelf rails for mounting wireless electronic shelf labels. The plastic shelf rails are sturdy enough to attach firmly to a supermarket shelf and are durable to stand up to the daily wear-and-tear of retail shopping. The plastic shelf rails are designed with precise tolerances to hold the electronic shelf labels firmly in place, preventing them from sliding to the wrong spot on the shelf. Additionally, the lower groove of the rail is shaped to engage latches at the bottom of the electronic shelf label thereby securing the electronic shelf label in the rail. The electronic shelf label can only be readily or easily removed by using a special tool. Locking the electronic shelf labels in place is an advantage for retailers in terms of shelf compliance and planogram management. The shelf rails are also designed to accommodate shelf talkers and other promotional materials.

Also provided is a shelf rail made by co-extruding flexible and rigid polyvinyl chloride (PVC) materials. A feature of the plastic shelf rails is a notch on the back to accommodate metal shelf brackets that attach the rail securely to the edge of the store shelves. To prevent the electronic shelf labels from sliding, they are held firmly in place by a gripping pad, which is co-extruded as a "bead" of flexible PVC co-extruded with the rigid PVC plastic rail.

Also provided is a plastic shelf rail optimized for lower shelves. The shelf rails tilts the electronic price display upwards so that it is easy to read. This and the other disclosed embodiments are versatile, lighter weight and less expensive to produce than the conventional metal shelf rails.

Also provided are transparent plastic covers for the shelf rail. The cover is preferably co-extruded with resilient ridges to provide a merchandising feature for holding paper or plastic cards. An additional feature of the invention is a plastic shelf rail with integrated cover, all co-extruded.

An additional embodiment of the invention is a holder which attaches to a supermarket shelf C-channel for holding the electronic shelf label. A feature of the holder is that it is optimized for normal or lower store shelves. A further embodiment of the holder is one for use without shelves. This holder has an adhesive backing for mounting the electronic shelf label near peghook displays, produce areas, free-standing display tables, deli and meat display cases, wire bins and other general merchandise areas.

DETAILED DESCRIPTION OF THE INVENTION

Figure 1:
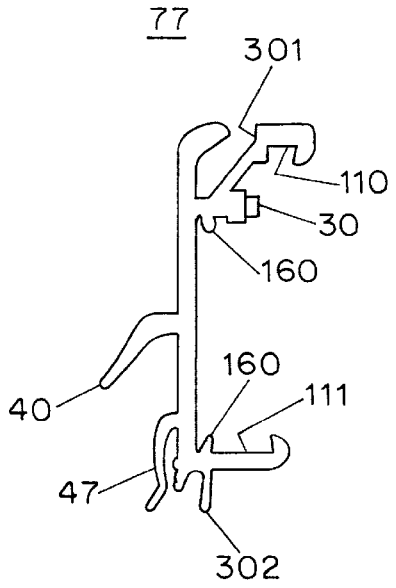
FIG. 1 is an end-view cross section of the shelf rail of the invention.

Turning to FIG. 1, there is shown a rail body 77 in cross section, preferably made of polyvinyl chloride (PVC). The rail body has features 110, 111 which are opposed to each other and which are shaped to hold an electronic price display (also called an electronic shelf label).

Figure 17:
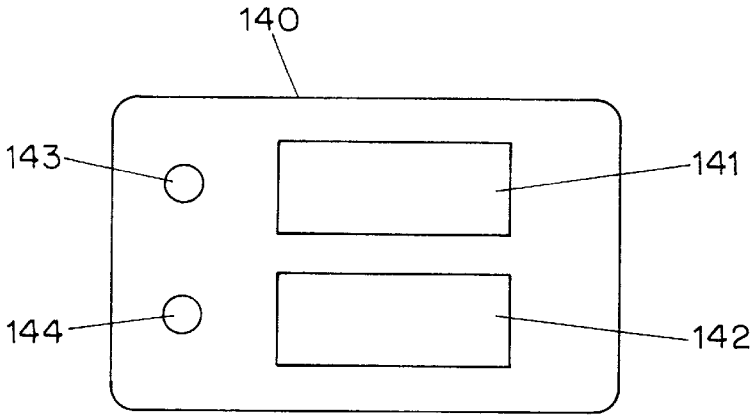
FIG. 17 is a front view of a typical electronic shelf label.
Figure 18:
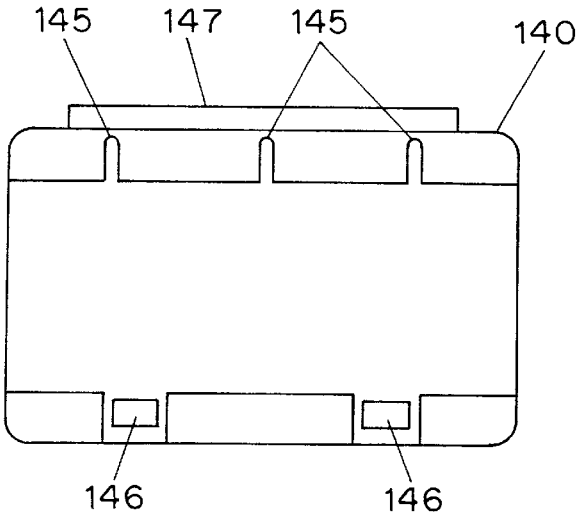
FIG. 18 is a rear view of a typical electronic shelf label.
Figure 19:
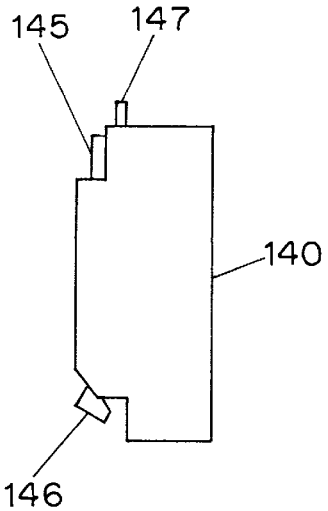
FIG. 19 is a side view of a typical electronic shelf label.

A typical electronic price display 140 (see front view in FIG. 17) has liquid-crystal panels 141, 142 to display prices, and buttons 143, 144 which may be pressed by a user. FIG. 18 shows a rear view with latches 146 at the bottom, and ridge 147 at the top. FIG. 19 is a side view showing top ridge 147, movable latches 146, and also rear-facing ridges 145, also visible in FIG. 18.

When the price display (also called a label) is snapped into a rail body 77, the ridge 147 engages feature 110 and the latches 146 engage feature 111. Features 160 are opposed to each other and permit sliding in a thin plastic or metal strip which can color-coordinate with the decor of the retail store. The spacing of the features 160 is preferably the same as that of a standard retail store C-channel so that decorative strips (or shelf talkers or other merchandising devices) that fit the standard retail store C-channel are also able to fit the features 160. Preferably, the ends of the rail are crimped to compress features 160 to prevent decorative strips, shelf talkers or other merchandising devices from being removed from the ends of the rails.

Figure 4:
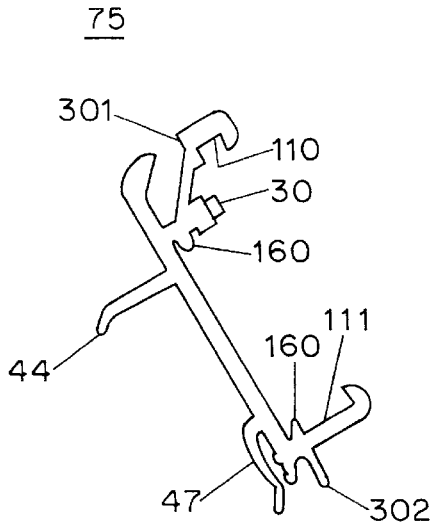
FIG. 4 is a cross-section view of a shelf rail optimized for lower shelves.

Preferably a resilient soft plastic bead 30, which may be PVC, is co-extruded with the hard plastic of the rail body 77. The bead 30 engages with the ridges 145 to keep the label from sliding along the length of the rail body 77. A corresponding resilient co-extruded feature with the same function appears in FIGS. 4 and 5 (item 30), FIG. 7 (item 31) and in FIG. 15 (item 33).

Figure 20:
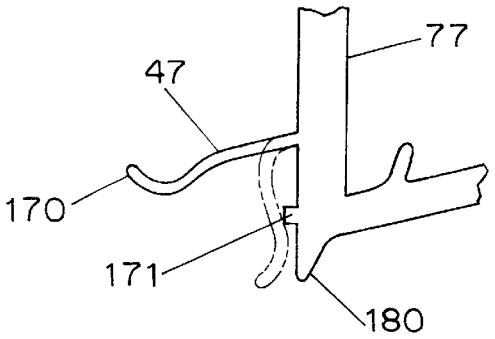
FIG. 20 is a cross-section view of a shelf rail showing the extra-large lip for inserting a paper or plastic card.

Along the lower edge of the rail body 77 (FIG. 1) is a feature 47 which is preferably thinner in cross-section than the rest of the rail body 77. During manufacture the feature 47 is extruded at an angle as shown in FIG. 20, and is folded down into place (shown by dotted lines) while the plastic is still somewhat soft. The feature 47 is shaped with an extra-large lip 170 (FIG. 20) which makes it easier to insert a paper or plastic card than with prior-art shelf rails.

Figure 8:
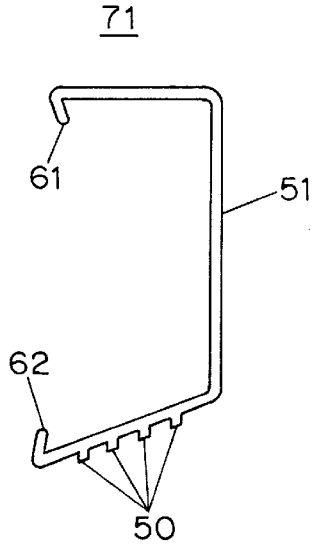
FIG. 8 is a cross-section view of a rail cover.

It will also be noted that features 301, 302 are incorporated in the cross-section of the rail. These features engage with features 61, 62 (FIGS. 8, 9) to keep the transparent cover 51, 70 in place.

Figure 2:
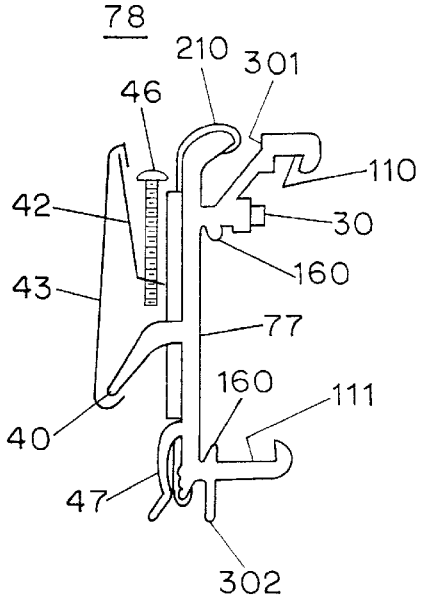
FIG. 2 is a cross-section view of the shelf rail of FIG. 1 with the clip assembly for mounting to the C-channel of a shelf.

A complete rail 78 for installation in a store is shown in FIG. 2. Mounted onto the rear of the rail body 77 is a clip assembly in three parts: a bracket 210, a slide 42, and a machine screw 46. When screw 46 is turned, the slide 42 moved upward in FIG. 2, tending to secure the rail 78 into the C-channel 43 in opposition with feature 40 of the rail body 77. Screw 46 may be a Phillips screw but is preferably a square-drive screw. The slide 42 and bracket 210 are both made of cold rolled steel which may be plated to resist corrosion. The slide 42 is heat-treated for strength.

Figure 3:
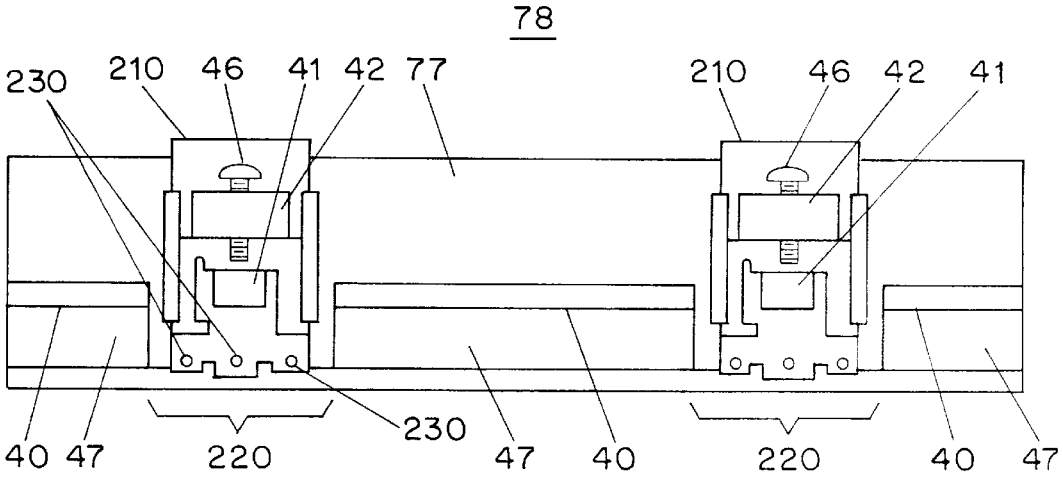
FIG. 3 is a rear view of the rail with clips shown in FIG. 2.

FIG. 3 shows the rail 78 in rear view. It will be appreciated that as the rail body 77 is extruded, it is of substantially constant cross section. Regions 220 are created after extrusion, and result from milling that removed most of rear features 40 and 47 to present a substantially flat rear face. Preferably, the milling is an automated process which occurs as the rail is extruded. Bracket 210 is attached to the rail body 77 by forming. Small dimples 230, and other dimples omitted for clarity in FIG. 3, are formed in the rear of the bracket 210 and provide a consistent engagement with the rear face of the rail body 77 despite any irregularities in the surface resulting from the afore-mentioned milling.

Feature 41 is formed into the bracket 210 and is substantially collinear with the edge of feature 40, thus providing a consistent engagement with the lower edge of the C-channel 43 (FIG. 2).

What is disclosed, in other words, is a method for use with a plastic rail, the rail having front and rear faces, the rail further having top and bottom edges, the rail formed by extrusion having substantially constant cross section, the rail having opposed first and second features 110,111 at the front top and front bottom of the rail, the opposed features defining grooves facing each other, the rail formed by extrusion having further a third feature 47 on the rear face extending outwardly by a first distance, the third feature spaced from the bottom of the rear face by substantially the first distance, the third feature formed at a cross-sectional thickness less than half that of the balance of the rail; the method comprising the steps of extruding the rail from soft plastic, and before the plastic has hardened, folding the third feature from the outwardly direction toward the bottom of the rear face. In addition it is possible to mill the rear face substantially flat at at least two locations along the length of the rail.

Figure 5:
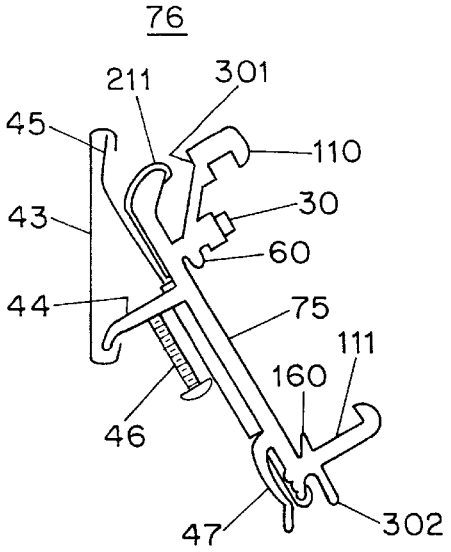
FIG. 5 is a cross-section view of a the shelf rail of FIG. 4 with the clip assembly for mounting to the C-channel of a shelf.
Figure 6:
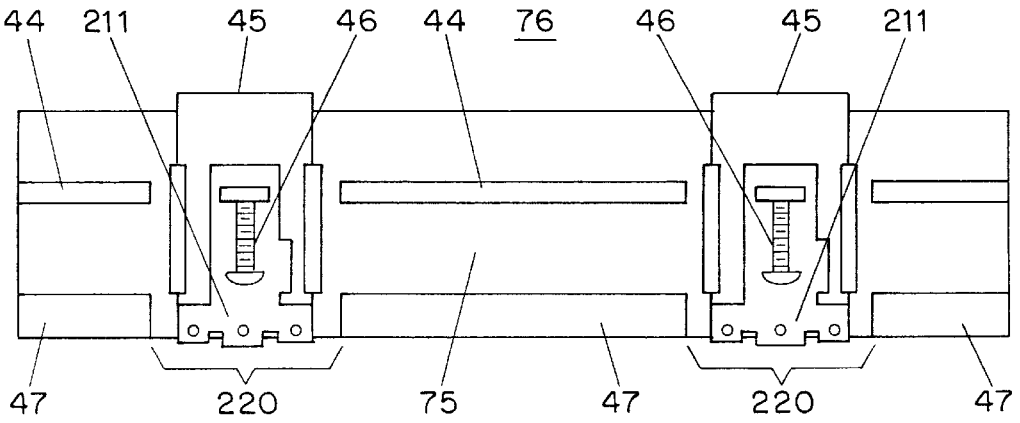
FIG. 6 is a rear view of the rail with clips shown in FIG. 5.

Rail 78 is well suited to the upper shelves of a retail store. Rail 76 (FIG. 5) is optimized, however, for lower shelves because it tilts the electronic price display upwards so that it is easy to read. Rail body 75 (FIG. 4) is formed with rear-facing feature 44 which protrudes more than feature 40 (FIG. 1), but is otherwise much like rail body 77. Bracket 211 (FIG. 5) and slide 45 and screw 46 are provided to secure the rail 76 to the C-channel 43. FIG. 6 shows the rail body 75 and bracket 211 and slide 45 in rear view. Milled areas 220 are provided as in FIG. 3.

What is provided in one embodiment is a rail in which the protrusion of the bracket 211 and the collinear plastic feature 44 each extend rearward and downwards from the rear face of the rail, and the protrusion of the slide 45 extends upwards from the rear face of the rail, and wherein the protrusions and the plastic feature are shaped so that the front face of the rail tilts upwards relative to the supermarket C-channel by at least twenty degrees.

Figure 11:
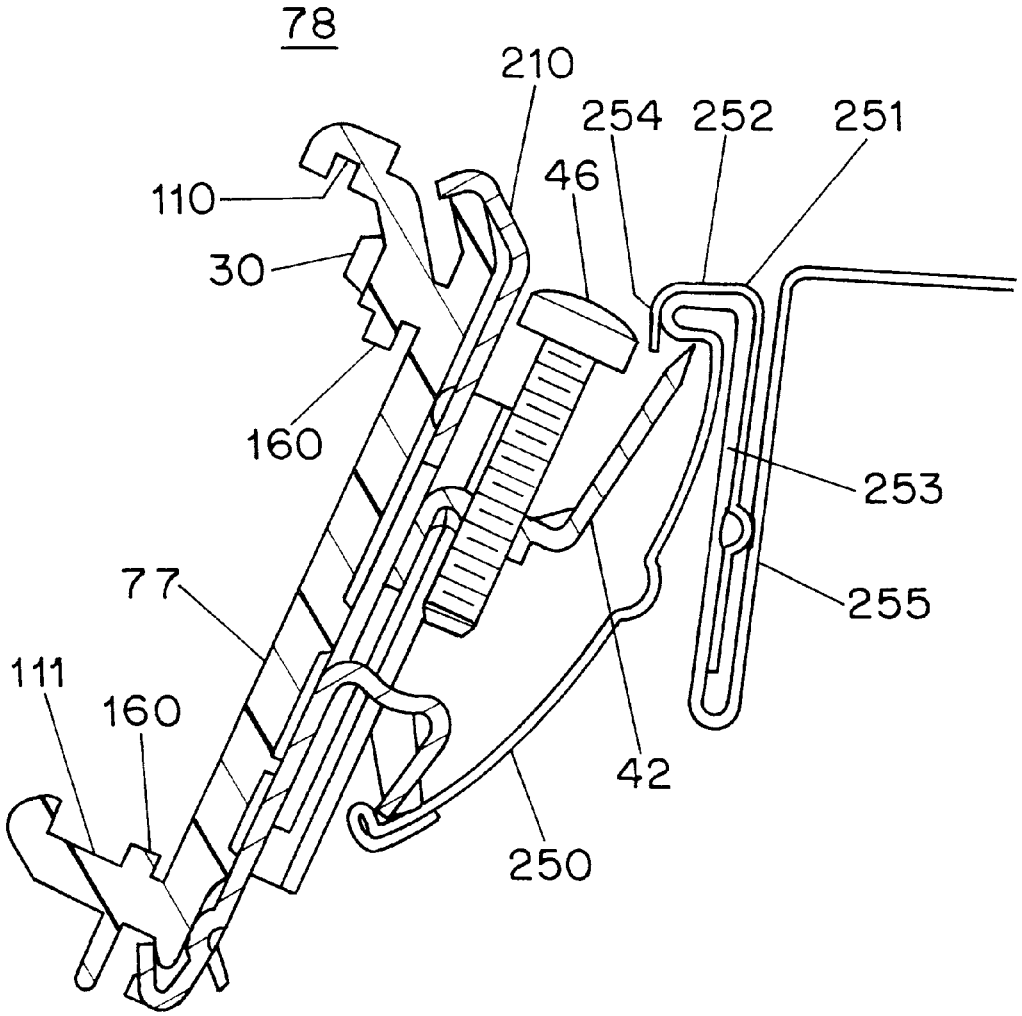
FIG. 11 is a cross-section view of a shelf and shelf rail connected by means of a locking clip.

A system for use with shelves that do not have a return on the top edge on the front curved section is shown in FIG. 11. A metal clip 251 having a flat portion 252 and a hook portion 253 is used to connect the rail to the shelf. The flat portion 253 of the clip is sized to fit into the slot in the shelf and the hook portion 252 is shaped to extend from the slot and lock around the upper edge of the curved front surface of the shelf to form a return 254. The flat portion 253 is shaped to form two bumps 255 to provide an interference fit with the slot in the shelf. The clip is preferably made from 0.032 inch thick C1050 spring steel, hardened and tempered to 44/48, and plated in bright nickel. The resulting shelf structure works well with the rails 76, 78 (FIGS. 2, 3, 5, 6). The clip is preferably about one inch wide to fit the brackets 210 for attaching a rail to shelving. Preferably the system entails using one clip per bracket for attaching the rail to shelving.

Stated differently, what is provided is an apparatus comprising an item of metal shelving formed from sheet stock and defining a substantially flat shelf, the shelf having a length and a front, the shelving having substantially constant cross-section along the front of the shelf and along most of the length of the shelf, the cross-section defining a curved front surface with upper and lower edges, the lower edge of the curved front surface shaped to form a first return, the curved front surface positioned substantially below the flat shelf, the sheet stock shaped to define a slot extending below the shelf, the slot located between the curved front surface and the flat shelf, the slot and the curved front surface meeting at the upper edge thereof; a metal clip 251 formed from sheet stock and having substantially constant cross section, the clip having a flat portion and a hook portion 253, the flat portion being substantially planar and sized to fit into the slot of the shelving, the hook portion shaped to extend from the slot and to lock around the upper edge of the curved front surface, the hook portion defining a second return 254 opposed to the first return, the flat portion of the clip fitted into the slot, and the hook portion locked around the upper edge of the curved front surface; a rail with front and rear faces, the rail further comprising a bracket on the rear face thereof, the bracket shaped to receive a slide movable relative to the bracket in first and second directions, the slide and bracket each having features engaging the first and second returns when the slide is moved in the first direction.

Figure 12:
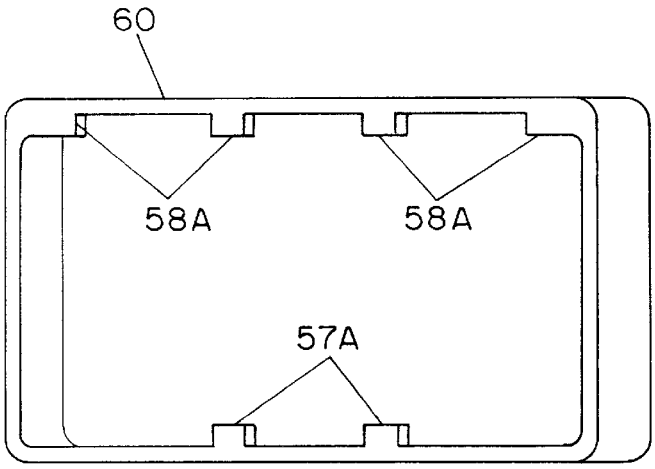
FIG. 12 is a front view of an electronic shelf label holder.
Figure 13:
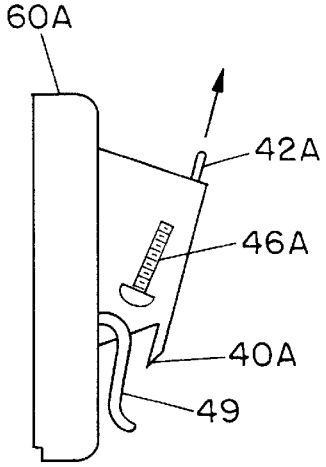
FIG. 13 is a side view of the electronic shelf label holder of FIG. 12.
Figure 14:
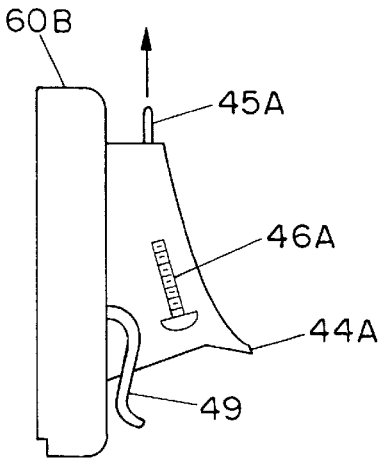
FIG. 14 is a side view of an electronic shelf label holder optimized for use on lower shelves.

FIG. 12 shows an individual label holder 60, preferably made of ABS. The holder has features 58A and 57A which engage ridge 147 and latches 146 (FIG. 19) in much the same way as features 110 and 111 (FIG. 1). The label holder 60 is sized to match the label with which it will be used. The label holder 60 can be narrow to hold a "spice label" that is only about two inches wide, or can be wide to accommodate a regular store label which is about 3¼ inches wide. FIG. 13 shows a variant 60A for normal store shelves (serving a role such as rail 78, FIG. 2). FIG. 14 shows a variant 60B for lower store shelves (serving a role such as rail 76, FIG. 5). In FIG. 13, feature 40A corresponds to feature 40 (FIG. 1). In FIG. 14, feature 44A corresponds to feature 44 (FIG. 5). In FIG. 13, feature 42A corresponds to feature 42 (FIG. 1). In FIG. 14, feature 45A corresponds to feature 45 (FIG. 5). In both FIGS. 13 and 14, and in FIG. 16, features 49 may be seen which hold a paper or plastic card in much the same way as feature 47 (FIG. 1).

Thus there is described a holder 60 having a front face and a back, the front face of the holder shaped to define a cavity having a substantially rectangular mouth with upper and lower edges, the holder further comprising at least one protrusion 58A at the upper edge of the mouth and at least one protrusion 57A at the lower edge of the mouth, the protrusions extending toward each other; the holder further comprising a feature extending from the back shaped to receive a slide and shaped to hold in threaded engagement a screw 46A, the slide and the feature having respective edges 40A, 44A, 42A, 45A positioned to engage a supermarket C-channel, the respective edges 42A and 45A are angled forward at 15° but are still parallel, the slide and screw disposed so that rotation of the screw in a first direction causes the respective edges to separate. The edges of the slide and feature may be shaped so that the front face of the holder is vertical (perpendicular to the floor). The edges of the slide and feature may be shaped (FIG. 14) so that the front face of the holder tilts upwards relative to the supermarket C-channel by at least twenty degrees.

Figure 15:
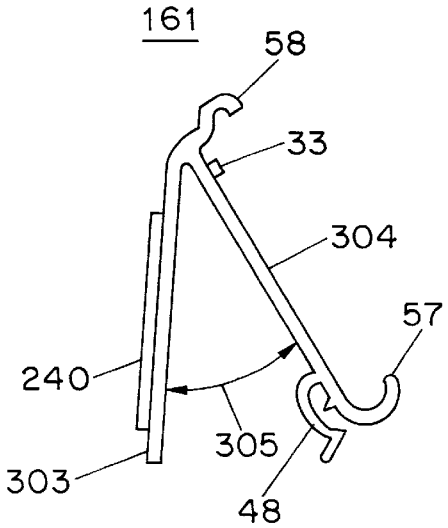
FIG. 15 is a cross-section view of an adhesive electronic shelf label holder.

FIG. 15 shows a label holder extruded preferably of PVC. The rear portion 303 and front portion 304 are separated by an angle 305 of between 0° and 30°, more preferably at an angle of 0°, 15° or 30°. An adhesive strip 240 is provided on the rear portion 303 which may be of an acrylic adhesive. Resilient co-extruded feature 33 serves to keep labels from sliding. Merchandising feature 48 serves a role much like that of feature 47 (FIG. 1) or feature 49 (FIGS. 13 and 14).

Thus in one embodiment there may be a plastic rail, the rail having front and rear faces, the rail further having top and bottom edges separated by a first distance, the rail formed by extrusion having substantially constant cross section, the rail having opposed first and second features 57, 58 at the front top and front bottom of the rail, the opposed features defining grooves facing each other, further comprising a resilient bead 33 on the front face thereof between the grooves and co-extruded with the rail; the rail further comprising a flat feature joined to the rail nearby to the top edge of the rear face, the flat feature extending by a distance at least half of the first distance, the flat feature having an adhesive 240 at its rearmost face. There may further be a removable strip protecting the adhesive. There may further be a feature 48 at the bottom rear edge defining a groove having opposing surfaces, the groove further characterized in that friction features are formed in the opposing surfaces.

It is considered desirable to provide transparent covers over the rails 76 and 78. One cover 71 (FIG. 8) is made of PETG. Features 61, 62 snap onto rail 78 or 76, engaging features 301, 302. Ridges 50 are desirably formed onto a face of the cover to assist the user in knowing which side should be "down" when the cover is to be snapped into place. Preferably the ridges are along the lower face so as not to collect dust.

There may thus be provided a transparent plastic cover 71 formed by extrusion and of substantially constant cross section, the cover having top, front, and bottom faces, the front face having top and bottom edges, each of the top and bottom faces having a rear edge and a front edge, the top face joined at its front edge to the front face at its top edge defining a first corner, the front face joined at its bottom edge to the bottom face at its front edge defining a second corner, each of the top and bottom faces having at its respective rear edge a hook formed in co-extrusion with its respective face, the hook formed with the top face opposing the hook formed with the bottom face, the bottom face having a plurality of ridges 50 in the bottom surface of the bottom face, formed in co-extrusion with the bottom face.

Figure 9:
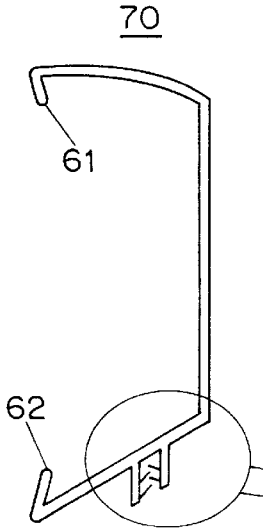
FIG. 9 is a cross-section view of a rail cover with co-extruded ridges for holding a card.
Figure 10:
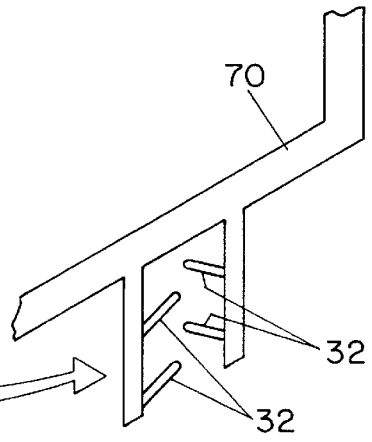
FIG. 10 is a blowup of the ridges shown in FIG. 9.

FIG. 9 shows another cover 70, made of rigid and flexible PVC which reduces glare. As shown in blowup FIG. 10, resilient ridges 32 are co-extruded with the cover and provide a merchandising feature for holding paper or plastic cards like feature 48 (FIG. 15), feature 47 (FIG. 1), or feature 49 (FIGS. 13,14).

Thus what is provided is a transparent plastic cover 70 formed by extrusion and of substantially constant cross section, the cover having top, front, and bottom faces, the front face having top and bottom edges, each of the top and bottom faces having a rear edge and a front edge, the top face joined at its front edge to the front face at its top edge defining a first corner, the front face joined at its bottom edge to the bottom face at its front edge defining a second corner, each of the top and bottom faces having at its respective rear edge a hook formed in co-extrusion with its respective face, the hook 61 formed with the top face opposing the hook 62 formed with the bottom face, the bottom face having a groove opening downwardly formed at the bottom surface of the bottom face, formed in co-extrusion with the bottom face, the groove defining two opposing surfaces, at least one of the opposing surfaces having formed in co-extrusion therewith a resilient feature extending toward another of the opposing surfaces. Optionally each of the opposing surfaces of the groove has at least two resilient features 32 formed in co-extrusion therewith. Also optionally the resilient feature is translucent. The cover may be made of polyvinyl chloride plastic.

Figure 7:
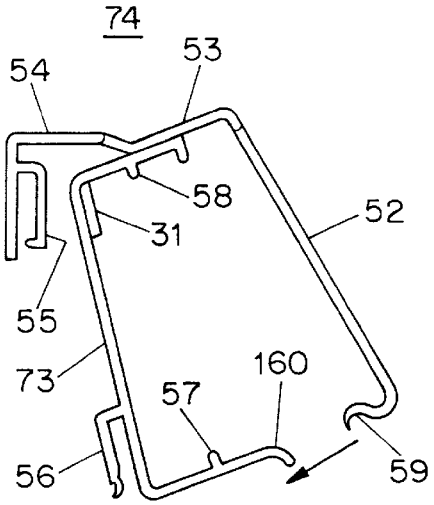
FIG. 7 is a cross-section view of a rail with integrated cover, all co-extruded.

FIG. 7 shows a rail assembly 74 with integrated cover 52, all co-extruded. Resilient feature 31 prevents lateral sliding of labels. Flexible co-extrusion 53 provides hinging action between main body 73 and rear member 54, and between main body 73 and cover 52. Feature 59 permits snapping cover 52 into place by engaging feature 160. Ridges 58, 57 secure a label. Merchandising feature 56 holds paper or plastic cards. Feature 55 attaches to a variety of carriers each of which can attach to a retail store shelf.

Thus there is described a plastic rail co-extruded with a transparent plastic cover and rear member, the rail having front and rear faces, the rail further having top and bottom edges, the rail having substantially constant cross section, the rail having opposed first and second features at the front top and front bottom of the rail, the opposed features defining grooves 57, 58 facing each other, the rail further having a third feature 56 on the rear face extending by a first distance, the third feature joining the rear face at a position spaced from the bottom of the rear face by substantially the first distance, the third feature substantially parallel with the rear face and defining a slot therebetween; the cover having front and bottom faces, the front face having top and bottom edges, the bottom face having a rear edge and a front edge, the front face joined at the top edge to the front top of the rail by a flexible hinge co-extruded with the rail, the bottom face having at its rear edge a hook formed in co-extrusion with its face; the rear member having front and rear faces, the rear member further having top and bottom edges, the rear member having substantially constant cross section, the rear member having a first feature at the top of the front face, the first feature extending away from the front face in a substantially perpendicular direction, the rear member having a second feature 55 on the front face extending by a first distance, the second feature joining the front face at a position spaced from the bottom of the front face by substantially the first distance, the second feature substantially parallel with the front face and defining a slot therebetween, the rear member joined at the first feature to the front top of the rail by a flexible hinge co-extruded with the rail. Optionally there may be a resilient bead 31 on the front face of the rail between the grooves 57, 58 and co-extruded with the rail.

Figure 16:
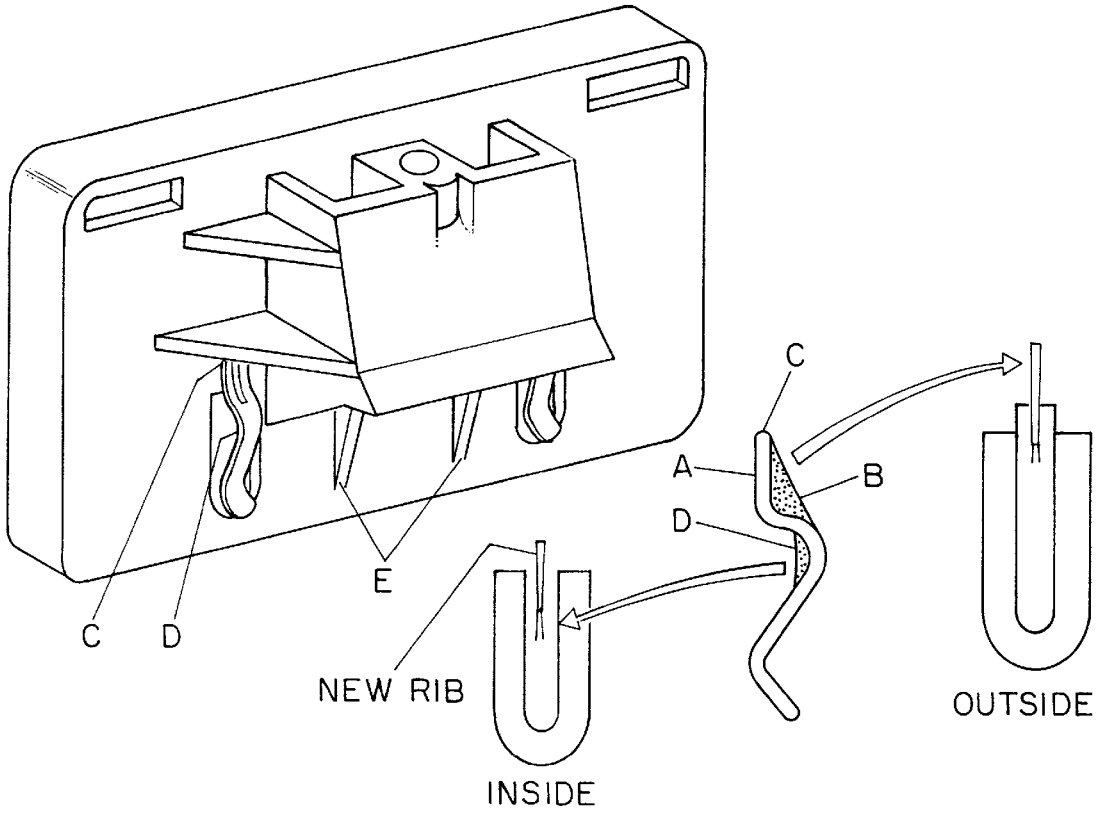
FIG. 16 is a perspective view of the electronic shelf label holder optimized for use on lower shelves, shown in FIGS. 12 and 14.

FIG. 16 is a perspective view of label holder 60, 60B (FIGS. 12 and 14).

Although the preferred embodiment of the apparatus of the invention has been described above in some detail, it should be appreciated that a variety of embodiments will be readily apparent to one skilled in the art. The description of the apparatus of this invention is not intended to be limiting to this invention, but is merely illustrative of the preferred embodiment.

While the methods for using plastic rails and metal shelving have been described in terms of preferred embodiments, it will be apparent to those skilled in the art that variations and modifications may be applied to the methods and in the steps or sequence of steps of the methods described herein without departing from the concept, spirit and scope of the invention.

We claim:

1. A method of making a plastic rail, the rail having front and rear faces, the rail further having top and bottom edges, said rail formed by extrusion having substantially constant cross section, said rail having opposed first and second features at the front top and front bottom of the rail, said opposed features defining grooves facing each other, said rail formed by extrusion having further a third feature on the rear face extending outwardly by a first distance, said third feature spaced from the bottom of the rear face by substantially said first distance, said third feature formed at a cross-sectional thickness less than half that of the balance of the rail; the method comprising the steps of:

extruding said rail from soft plastic;

before the plastic has hardened, folding said third feature from said outwardly direction toward said bottom of the rear face.

2. The product of the method of claim 1.

3. The method of claim 1 further characterized in that the rail has a length, the method further comprising the step, performed after the folding step, of milling said rear face substantially flat at at least two locations along the length of the rail.

4. A plastic rail, the rail having front and rear faces, the rail further having top and bottom edges, said rail formed by extrusion having substantially constant cross section, said rail having opposed first and second features at the front top and front bottom of the rail, said opposed features defining grooves facing each other, said rail formed by extrusion having further a third feature on the rear face extending by a first distance, said third feature joining the rear face at a position spaced from the bottom of the rear face by substantially said first distance, said third feature formed at a cross-sectional thickness less than half that of the balance of the rail, said third feature substantially parallel with said rear face and defining a slot therebetween.

5. The rail of claim 4 further comprising friction features on opposing surfaces of the third feature and of the rear face.

6. The rail of claim 4 having a length, said rail further characterized in that after extrusion, said rear face is milled substantially flat at at least two locations along the length of the rail.

7. A method of making a plastic rail, the rail having front and rear faces, the rail having a length, the rail further having top and bottom edges, said rail formed by extrusion having substantially constant cross section, said rail having opposed first and second features at the front top and front bottom of the rail, said opposed features defining grooves facing each other; said rail further comprising a resilient bead on the front face thereof between said grooves and co-extruded with said rail, the method comprising the steps of:

extruding said rail from soft plastic;

milling said rear face substantially flat at at least two locations along the length of the rail;

mounting at each of said at least two locations a clip assembly, each said clip assembly comprising a metal bracket mounted to said rail, a metal slide slidable relative to said bracket, and a metal screw in threaded relation with said bracket and sliding said slide in response to rotation of the screw.

8. The method of claim 7 wherein milling occurs as the rail is extruded.

9. The method of claim 7, wherein the extruded rail has two ends, further comprising crimping the ends of the rail.

10. The product of the method of claim 7.

11. A plastic rail, the rail having front and rear faces, the rail further having top and bottom edges, said rail formed by extrusion having substantially constant cross section, said rail having opposed first and second features at the front top and front bottom of the rail, said opposed features defining grooves facing each other, said rail further comprising a resilient bead on the front face thereof between said grooves and co-extruded with said rail, said rail further characterized in that after extrusion, said rear face is milled substantially flat at at least two locations along the length of the rail, said rail further comprising mounted at each of said at least two locations a clip assembly, each said clip assembly comprising a metal bracket mounted to said rail, a metal slide slidable relative to said bracket, and a metal screw in threaded relation with said bracket and sliding said slide in response to rotation of the screw.

12. The rail of claim 11 wherein the bracket and slide are each plated and the slide is made of hardened steel.

13. A plastic rail, the rail having front and rear faces, the rail further having top and bottom edges, said rail formed by extrusion having substantially constant cross section, said rail having opposed first and second features at the front top and front bottom of the rail, said opposed features defining grooves facing each other, said rail further characterized in that after extrusion, said rear face is milled substantially flat at at least two locations along the length of the rail, said rail further comprising mounted at each of said at least two locations a clip assembly, each said clip assembly comprising a metal bracket mounted to said rail, a metal slide slidable relative to said bracket, and a metal screw in threaded relation with said bracket and sliding said slide in response to rotation of the screw;

said bracket and slide each having metal protrusions with respective edges, said edges spaced to engage respective grooves in a supermarket C-channel in response to rotation of the screw;

said plastic rail further characterized in that there is provided, extruded with said rail, a plastic feature with an edge substantially collinear with the metal protrusion of the bracket.

14. The rail of claim 13 wherein the slide is made of hardened steel.

15. The rail of claim 13 wherein the protrusion of the bracket and the collinear plastic feature each extend rearward and downwards from the rear face of the rail, and the protrusion of the slide extends rearwards and upwards from the rear face of the rail, and wherein the protrusions and the plastic feature are shaped so that the front face of the rail is substantially perpendicular to the flat shelf or the floor.

16. The rail of claim 15 further comprising a resilient bead on the front face thereof between said grooves and co-extruded with said rail.

17. The rail of claim 13 wherein the protrusion of the bracket and the collinear plastic feature each extend rearward and downwards from the rear face of the rail, and the protrusion of the slide extends forwards and upwards from the rear face of the rail, and wherein the protrusions and the plastic feature are shaped so that the front face of the rail tilts upwards relative to the floor by at least twenty degrees.

18. The rail of claim 17 further comprising a resilient bead on the front face thereof between said grooves and co-extruded with said rail.

19. A plastic rail, the rail having front and rear faces, the rail further having top and bottom edges separated by a first distance, said rail formed by extrusion having substantially constant cross section, said rail having opposed first and second features at the front top and front bottom of the rail, said opposed features defining grooves facing each other, further comprising a resilient bead on the front face thereof between said grooves and co-extruded with said rail; said rail further comprising a flat feature joined to the rail nearby to the top edge of the rear face, said flat feature extending by a distance at least half of said first distance, said flat feature having an adhesive at its rearmost face.

20. The rail of claim 19 further comprising a removable strip protecting said adhesive.

21. The rail of claim 19 further comprising a feature at the bottom rear edge defining a groove having opposing surfaces, said groove further characterized in that friction features are formed in the opposing surfaces.

* * * * *